US006308501B1

(12) United States Patent
Brinkman

(10) Patent No.: US 6,308,501 B1
(45) **Date of Patent: *Oct. 30, 2001**

(54) PACKAGING APPARATUS

(76) Inventor: Jacob Brinkman, 9 Newton Place, Hamilton (NZ)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/259,459

(22) Filed: Mar. 1, 1999

(30) Foreign Application Priority Data

Feb. 27, 1998 (NZ) ..... 329864
Jun. 26, 1998 (NZ) ..... 329864

(51) Int. Cl.[7] ..... B65B 3/00; B65B 43/30

(52) U.S. Cl. ..... 53/459; 53/370.1; 53/386.1; 53/469; 53/481; 53/571

(58) Field of Search ..... 53/570, 571, 459, 53/386.1, 122, 518, 250, 573, 370.6, 469; 414/778

(56) References Cited

U.S. PATENT DOCUMENTS

| | | | | |
|---|---|---|---|---|
| 2,597,922 | * | 5/1952 | Conti | 414/778 |
| 2,754,646 | * | 7/1956 | Orstrom | 53/571 |
| 2,950,589 | * | 8/1960 | Litchard | 53/571 |
| 3,225,515 | * | 12/1965 | Inglett | 53/573 |
| 3,380,222 | * | 4/1968 | Bergmann | 53/571 |
| 3,755,986 | * | 9/1973 | Hudson | 53/370.6 |
| 3,861,546 | * | 1/1975 | Montgomery | 414/778 |
| 3,945,173 | * | 3/1976 | Buzzi | 53/571 |
| 3,953,020 | * | 4/1976 | Ruf | 53/570 |
| 4,047,360 | * | 9/1977 | Minaev | 53/122 |
| 4,078,358 | * | 3/1978 | Henderson | 53/573 |
| 4,086,746 | * | 5/1978 | Christy | 53/386.1 |
| 4,516,384 | * | 5/1985 | Imperiale | 53/570 |
| 4,873,815 | * | 10/1989 | Tetenborg | 53/386.1 |
| 5,024,042 | | 6/1991 | Meyer | 53/168 |
| 5,056,299 | * | 10/1991 | Furukawa | 53/571 |
| 5,177,939 | * | 1/1993 | Lipes | 53/373.6 |
| 5,179,819 | * | 1/1993 | Sukeyasu | 53/386.1 |
| 5,195,303 | * | 3/1993 | Tomanovits | 53/384.1 |
| 5,987,854 | * | 11/1999 | Killinger | 53/570 |

FOREIGN PATENT DOCUMENTS

| | | |
|---|---|---|
| A-55818/96 | 12/1996 | (AU) . |
| 2 074 972 A | 11/1981 | (GB) . |
| 2 102 372 A | 2/1983 | (GB) . |

OTHER PUBLICATIONS

General Brochure G4—"Packing Excellence" undated instructional, technical and promotional material of Paste Packer Ltd. packing apparatus.

Test and promotional material describing United Bakery Equipment "Bread Bagger" UBE Model 50–R, undated.

* cited by examiner

*Primary Examiner*—John Sipos
(74) *Attorney, Agent, or Firm*—Marshall, Gerstein, & Borun

(57) ABSTRACT

A packaging apparatus for packaging a product, said apparatus having a bag magazine containing a number of preformed bags from which bags are separated by a lifting member which lifts each bag at or adjacent to its sealed end; a support device for separating a bag from the magazine and presenting it for opening by a movable gripping and opening device; means for opening the inlet region of the bag by said gripping and opening device, said gripping and opening device transporting the bag onto an outlet, said outlet being configured to grip the inlet region of the bag such that a product can then be ejected into the bag.

26 Claims, 9 Drawing Sheets

PACKAGING APPARATUS

TECHNICAL FIELD OF THE INVENTION

The present invention relates to packaging apparatus, and in particular to packaging apparatus for packaging in plastics bags, semi rigid blocks of product such as cheese.

BACKGROUND ART

Conventional packaging apparatus for such applications generally involve one or more towers in which a product is collected ready for packaging, and an ejection apparatus at the base end of each tower for ejecting the product in predetermined lengths from a horizontally aligned outlet thereof onto a horizontal support device. The ejection apparatus generally has a square or rectangular shaped outlet, and is provided with a device for gripping a bag when fitted over the outlet. In operation, the inlet portion of a bag which is generally made of an impervious material such as plastics, is manually fitted over the outlet and the gripping device then operated to hold the bag in place. The ejection apparatus is then operated to eject a length of the product into the bag, which is cut off by a cutter at a predetermined size, and the gripping device released, to allow the filled bag to be pushed by an ejector of the ejection apparatus onto the support device.

Since the operation of fitting the bag to the outlet of the ejection apparatus, is carried out manually, the operation is time consuming, contaminants can be introduced to the product, and space is required to allow the operator access to the region.

The support device is generally in the form of a conveyor belt which then conveys the filled bag to a weighing apparatus where the bag is weighed. If the weight is below a predetermined weight, then the bag must be topped up with additional product. Since this is done manually and generally requires turning the bag to an upright condition with the opening at the top, the operation is time consuming and contaminants can be introduced to the product. (Incidentally a continual problem here is that human operators develop occupational overuse syndrome in their wrists from the activity). To minimise this requirement, the bags are generally over filled, thus providing more product than necessary with a loss of profit.

Once the bag has been weighed, the top of the bag is folded to form gussets ready for scaling under vacuum, or alternatively a "pillowcase seal" is prepared by a process involving stretching part of the neck of the bag. This also is done manually, and is thus time consuming and can introduce contaminants to the product. Moreover, there is the possibility of finger contamination of the surface of the inlet portion of the bag, which can cause defective sealing by the subsequent sealing apparatus. Furthermore, the manual operation results in a lack of uniformity of the surfaces which can result in wrinkles, again affecting the subsequent sealing operation. Moreover, the bag must be accurately positioned by hand on the conveyor so that the inlet portion is lined up with scaling bars of the subsequent vacuum sealing apparatus.

OBJECT OF THE INVENTION

It is an object of the present invention to provide a packaging apparatus which addresses the above problems with conventional apparatus, or at least provides the public with a useful choice.

DISCLOSURE OF THE INVENTION

According to a first aspect of the present invention there is provided a packaging apparatus for packaging in bags, semi rigid blocks of product ejected in predetermined sizes from a substantially horizontally aligned outlet of a product ejection apparatus onto a substantially horizontal support device, the product ejection apparatus having means to grip a bag when fitted over the outlet, the packaging apparatus comprising a bag fitting apparatus for fitting an inlet region of a bag over an outer peripheral surface of the outlet.

In another aspect the invention broadly consists of a packaging apparatus adapted for packaging a product which is moved substantially horizontally into a bag, said packaging apparatus comprising: a bag fitting apparatus including a bag supply means, means for supplying a bag from the bag supply means, and means for holding an inlet region of the bag open to receive said product.

By providing a bag fitting apparatus for the packaging apparatus, then problems due to the manual operation of fitting the bag to the outlet can be eliminated.

Bags may be supplied to the bag fitting apparatus by any suitable means. For example this may be a standard bag supply device used with bag packaging equipment, similar to that made by Matam of the Netherlands. Alternatively the bags may be supplied from a novel bag supply device wherein the bags are stored in a storage magazine in a stack in a flattened condition. Means may be provided which separate and isolate each bag from the stack to overcome obstacles such as the presence of electrostatic cling between the bags in the stack.

The bag fitting apparatus may comprise any suitable device whereby the inlet region of a bag can be fitted over the outer peripheral surface of the outlet.

For example this may comprise: a bag opening device for opening an inlet to a bag supplied thereto, a bag gripping device for releasably gripping an inlet portion of a bag opened by the bag opening device, and an actuating device for moving the bag gripping device between a position where an inlet portion of a bag is gripped by the bag gripping device and a position where the inlet portion of the bag being gripped by the bag gripping device is positioned over the outer peripheral surface of the outlet.

The bag opening device may comprise any suitable device whereby the inlet to a bag supplied thereto may be opened sufficiently to enable gripping by the gripping device. For example this may comprise: an opening member provided with an attachment device for attaching the opening member to an outer surface of the bag, and a positioning device for moving the opening member between a first position wherein a bag can be attached to the opening member by the attaching device, and a second position wherein a wall of a bag attached by the attachment device is moved to thereby open the bag inlet.

The attachment device for attaching the opening member may involve any suitable means whereby the opening member can be releasably attached to the outer surface of the bag. For example this may comprise a suction device for providing a negative pressure force to an outer face of the bag. Such a device may involve a plurality of suction cups arranged along an outer surface of a member and a device for releasably drawing a vacuum in the suction cups.

The abovementioned bag gripping device may comprise any suitable device whereby the inlet portion of a bag may be gripped and held in an open condition. For example this may comprise: two members supported in spaced apart relation by respective arms so as to be movable relative to each other between a first separation distance and a second separation distance, the two members being adapted to fit inside the bag inlet when at the first separation distance and to grip the bag when at the second separation distance. Preferably the two members are arranged parallel to each other so as to grip opposite sides of the bag inlet. With is arrangement, in the case where the outer faces at the inlet of the bag is being held by suction devices, the action of moving to the second separation distance to grip the bag can be used to separate the opposite sides of the bag from the suction devices. The bag gripping device may further comprise a rotation device for turning the two members about a longitudinal axis thereof when the bag gripping device is positioned over the outer peripheral surface of the outlet. With this arrangement the two members may have a flat portion eccentric to their axis of rotation so that they can be released from the gripping condition by simply rotating the two members and moving them away from the end of the bag.

The abovementioned actuating device may comprise any suitable device whereby the gripping device can be moved between the beforementioned positions. For example this may comprise a shaft and a mounting device for mounting the shaft so as to be rotatable about a longitudinal axis thereof and so as to be movable in a substantially horizontal plane, the shaft being provided with an attachment device at opposite ends thereof for attachment to the arms of the bag gripping device.

In the case where the bag supply device comprises a bag storage device for storing a predetermined number of preformed bags in a stack in a flattened condition, then the bag opening device may be arranged such that the second position of the opening member is further displaced relative to the first position such that a bag attached to the opening member is moved to a wall attachment position, and there is further provided a device for holding a wall of the bag when at the wall attachment position.

By further providing a device for holding a wall of the bag when at the wall attachment position, then the bag inlet can be more securely held to facilitate gripping by the bag gripping device.

Furthermore the arrangement may be such that the positioning device is adapted to move the opening member from the displaced second position to a third position wherein the inlet of a bag which is being held by the wall holding device is further opened.

By further opening the inlet to the bag, in this way, then the bag inlet can be even more securely held to facilitate gripping by the bag gripping device.

Furthermore the arrangement may be such that the wall holding device comprises a suction device for providing a negative pressure force to an outer face of the bag. Here again this may involve a plurality of suction cups arranged along an outer surface of a member and a device for releasably drawing a vacuum in the suction cups.

According to another of the present invention there is provided a packaging apparatus substantially as described above which further comprises a positioning apparatus for accurately positioning a bag filled with a product by the ejection apparatus, relative to a conveying path subsequent to the horizontal support device.

The positioning apparatus may involve any suitable device whereby the bag can be accurately positioned on a conveyor. For example this may comprise a double plane support device comprising a first plane support surface and a second plane support surface aligned substantially perpendicular to each other, the support surfaces having a device for supporting a product resting thereon and moving or allowing movement of the product in a longitudinal direction mutually parallel to the planes, and a mounting device for supporting the double plane support device so as to be movable between a first position where the first plane support surface is substantially horizontal, and a second position wherein the second plane support surface is substantially horizontal.

With such a construction, a bag lying horizontally on the surface of the horizontal support device after being filled by the ejection apparatus, can be tilted through 90 degrees by the positioning apparatus to bring the bag into an upright condition with the inlet portion facing upwards. Moreover, during the tilting operation the bag will slide sideways on the first plane support surface to rest against the second plane support surface, thus accurately aligning the bag with a predetermined path along the conveying path.

According to yet another of the present invention there is provided a packaging apparatus substantially as described above which further comprises a mechanically operated supplementary filling apparatus for filling additional product into a bag subsequent to being filled by the product ejection apparatus. By providing a supplementary filling apparatus, the conventional manual operation can be eliminated together with its inherent problems. Moreover, the filling operation can be carried out effortlessly and accurately for each bag, and hence the bags can initially be slightly under filled by the ejection apparatus and topped up to an accurate weight by the filling apparatus, thus avoiding overfilling with its inherent loss of profit.

The supplementary filling apparatus may comprise any suitable device whereby a predetermined weight of product can be filled into a bag. For example this may comprise a discharge device mounted over a conveying path of th packaging apparatus downstream of the product ejection apparatus for discharging a product downwards from an outlet therefrom, and a device for moving the product discharge device relative to the conveying path.

According to yet another aspect of the present invention there is provided a packaging apparatus substantially as described above which further comprises a folding apparatus for folding an inlet to a bag filled with product and resting on a support, into a suitable form for subsequent sealing. Again by providing a folding apparatus, the abovementioned problems inherent with manual folding can be eliminated.

The folding apparatus may comprise any suitable device whereby the inlet to the bag can be folded into a suitable form for subsequent sealing. For example this may comprise fingers mounted relative to a base member, and a finger actuating device for inserting the fingers into an inlet of the bag and appropriately folding side walls of the bag relative to each other to form a folded inlet suitable for sealing by a sealing device, and a fastening device for fastening the folded inlet of the bag so as to prevent unfolding.

By additionally including a fastening device, then the folded portion can be reliably held in the folded condition while the bag is being conveyed to a subsequent sealing device.

Furthermore there may further be provided an evacuating device for removing gas from inside the bag at the time of folding, and a sealing device for sealing the bag once the gas has removed.

In one possible arrangement, the evacuating device may comprise a passage formed inside at least one of the fingers of the folding apparatus, and a device for removing gas from the bag via the passage.

In the case where evacuating and sealing is not carried out at the time of folding, the packaging apparatus as described above may further comprise a positioning apparatus for mechanically positioning a bag folded by the folding apparatus, relative to a conveying path leading to a sealing apparatus. By mechanically positioning a bag folded by the folding apparatus, relative to the conveying path leading to the sealing apparatus, then problems such as defective sealing in the subsequent sealing apparatus due to inaccurate positioning, inherent with a manual positioning operation, can be eliminated.

The positioning apparatus, as with the beforementioned positioning apparatus provided prior to the supplementary filling apparatus, may comprises a double plane support device comprising a first plane support surface and a second plane support surface aligned substantially perpendicular to each other, the support surfaces having a device for supporting a product resting thereon and moving or allowing movement of the product in a longitudinal direction mutually parallel to the planes, and a mounting device for supporting the double plane support device so as to be movable between a first position where the first plant is substantially horizontal, and a second position wherein the second plane is substantially horizontal. As mentioned before, such an arrangement enables accurate alignment of the bag with a predetermined path along the conveying path.

According to another aspect of the present invention there is provided a method of packaging semi rigid blocks of material ejected in predetermined lengths from a substantially horizontally aligned outlet of an ejection apparatus onto a substantially horizontal support device, involving the steps of: opening an inlet to a bag supplied from a bag supply device, operating a gripping device so as to grip the bag in the region of the inlet, moving the bag so as to position the opening over a peripheral surface of the outlet of the ejection apparatus, releasing the gripping device and moving the gripping device away from the vicinity of the outlet, and gripping the bag inlet region over the outlet by a separate gripping device.

In yet another aspect the invention can broadly be said to consist of a method of packaging involving the steps of: opening an inlet to a bag supplied from a bag supply device, operating gripping means so as to grip said bag in the region of said bag inlet, moving said bag so as to position said opening in a receptive position to receive product(s) to be packaged, releasing said gripping means and moving said gripping means away from the vicinity of the bag inlet.

In the case where the gripping device comprises two elongate members with side faces supported on arms, then operating the gripping device so as to grip the bag involves inserting the members into the inlet and moving the members apart so that the side faces respectively press against opposite inside surfaces of the bag.

Moreover, the step of releasing the gripping device may involve turning the two members about longitudinal axes thereof so as to separate the side faces from the opposite inside surfaces of the bag, and removing the members away from the vicinity of the outlet.

Furthermore there is provided a method of accurately positioning a product filled bag, relative to a conveying path comprising the steps of: providing a double plane support device comprising a first plane support surface and a second plane support surface inclined and positioned relative to each other such that a bag to be positioned can be supported by both of the support surfaces when the planes are tilted as one to a predetermined inclination, and mounting the double plane support device such that in a final condition an intersection of the first and second planes is at a predetermined position with respect to the conveying path, tilting the double plane support device such that the first plane support surface is substantially horizontal, placing a bag to be positioned, onto the first plane support surface, and tilting the double plane support device to a final condition such that the bag slides on the first plane support surface to rest against the second plane support surface.

Since in the final condition the intersection of the first and second planes is at a predetermined position with respect to the conveying path, then the bag which has slid into position against the second plane support surface will be accurately aligned with the conveying path.

In the above, the invention has been described in relation to a packaging apparatus comprising a number of apparatus. However the invention also covers these apparatus, when provided separate from the packaging apparatus. Moreover, the invention also covers the abovementioned various methods when used separate from a packaging apparatus.

The invention may also broadly be said to consist in the parts, elements and features referred to or indicated in the specification of the application, individually or collectively, and any or all combinations of any two or more of said parts, elements or features, and where specific integers are mentioned herein which have known equivalents these are deemed to be incorporated herein as if individually set forth.

Further aspects of the present invention will become apparent from the following description given in conjunction with the appended drawings.

BEST MODE FOR CARRYING OUT THE INVENTION

Figure 1:
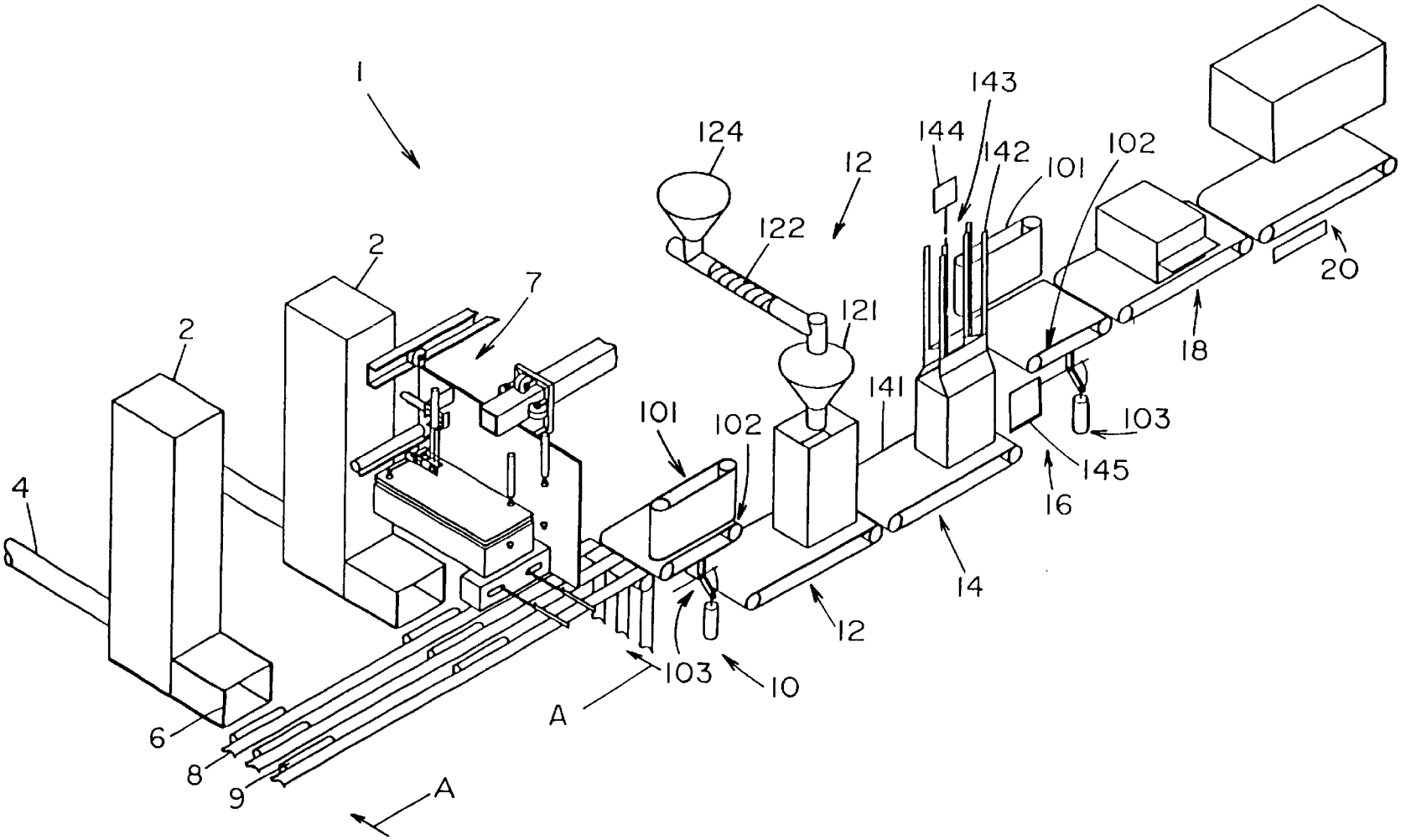
FIG. 1 is a perspective view of the essential features of a packaging apparatus according to an embodiment of the present invention.

FIG. 1 is a perspective view of the essential features of a packaging apparatus according to an embodiment of the present invention generally indicated by arrow 1, for packaging in plastics bags, semi-rigid blocks of product such as cheese. The packaging apparatus 1 of this embodiment comprises two conveyor paths (FIGS. 2A–2E) each having five towers 2 (only two shown in the figure), in which the product is collected ready for packaging, and an ejection apparatus 4 at the base end of each tower 2 for ejecting the product in predetermined lengths from a horizontally aligned rectangular outlet 6 onto a horizontal support device in the form of a conveying table 8. The conveying table 8 is additionally provided with transverse conveying rollers generally indicated by arrow 9 (FIGS. 2A–2E) in the vicinity of the outlet 6 to facilitate pushing a filled bag onto the conveying table 8 by an ejector of the ejection apparatus 4.

A feature of the packaging apparatus 1 is a bag fitting apparatus generally indicated by arrow 7 for fitting an inlet region of a bag over an outer peripheral surface of the outlet 6. The bag fitting apparatus is mounted on upper and lower tracks 9*a,* 9*b* (FIGS. 2A–2E) so as to be movable between the respective ejection apparatus 4, for presenting bags thereto.

With this embodiment, the bag fitting apparatus is supplied from a bag supply apparatus generally indicate by arrow 70, wherein bags are stored in a stack on top of each other.

The packaging apparatus 1 also comprises a positioning apparatus in the form of a block erector 10 generally indicated by arrow 10 for tilting a bag which has been filled with product by the ejection apparatus 4 into an upright condition.

Furthermore there is provided a supplementary filling apparatus in the form of a check weigher and top up apparatus generally indicated by arrow 12 for checking the weight of the filled bag, and topping up with additional product if the weight is less than a specified weight.

Moreover, there is provided a folding apparatus in the form of a bag stretcher and spot sealing apparatus generally indicate by arrow 14 for folding an inlet to a bag which has been filled and topped up with product by the check weigher and top up apparatus 12, into a suitable form for subsequent sealing.

After the bag stretcher and spot sealing apparatus 14, there is provided another positioning apparatus in the form of a block erector 16 similar to the block erector 10, for turning the filled bag back onto its side, and accurately positioning the filled bag relative to the conveying path leading to a collating apparatus 18 and then on to a vacuum sealing apparatus 20.

The vacuum sealing apparatus 20 is a conventional vacuum sealing apparatus having a rail along which the folded opening of the bag slides, which leads to a heat sealing device inside a vacuum chamber. Once the chamber has been evacuated to predetermined conditions, thereby drawing air out of the spot scaled (partially sealed) bag, the inlet to the bag is sealed by the heat sealing device, thus completing the packaging operation.

Instead of the sealing apparatus 20, a suitable sealing apparatus as described later, may be provided at the bag stretching and spot sealing apparatus 14.

Figure 2A:
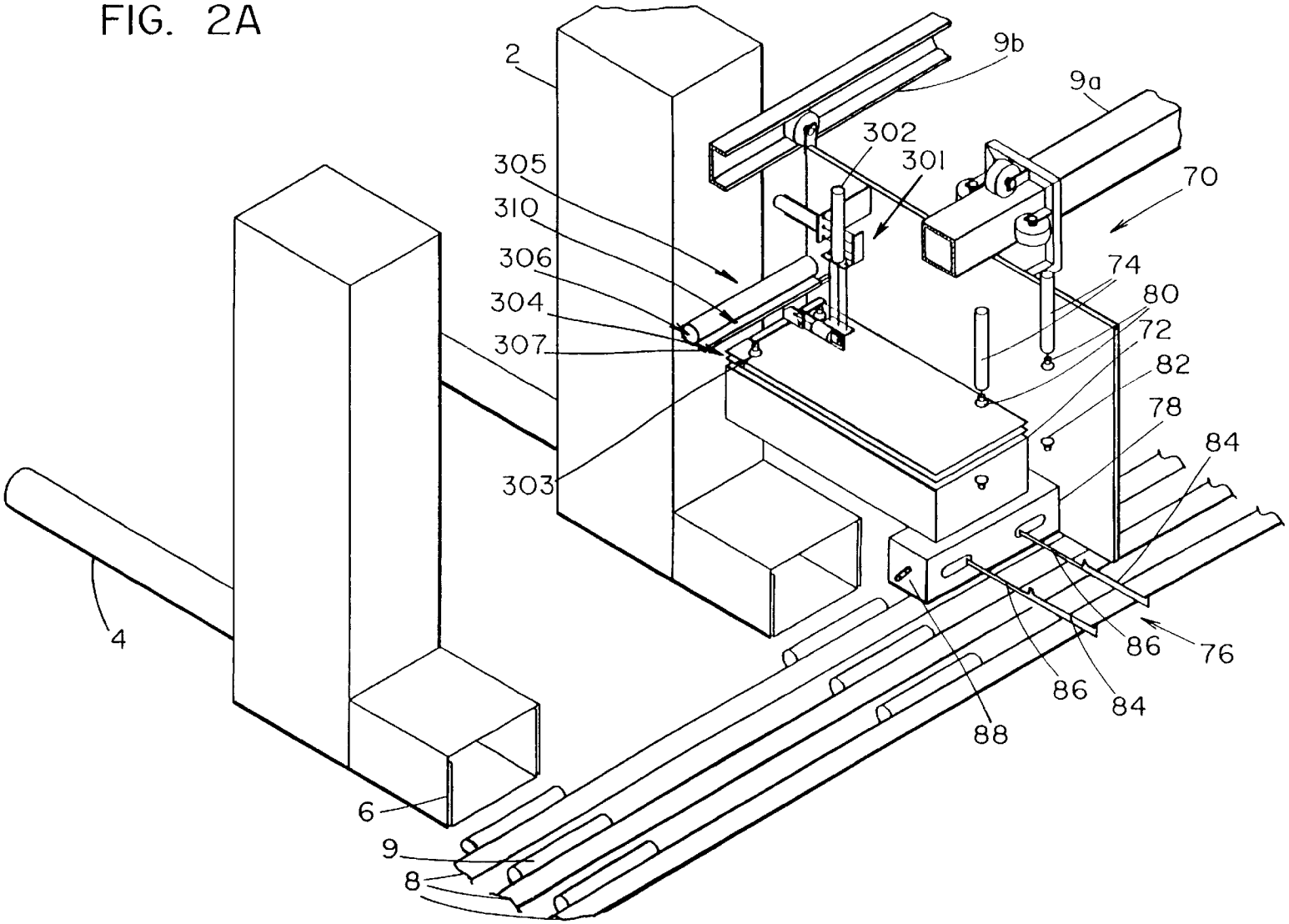
FIG. 2A is perspective view taken along line A—A of FIG. 1 and illustrating a bag fitting apparatus according to an embodiment of the present invention in a first position.
Figure 2B:
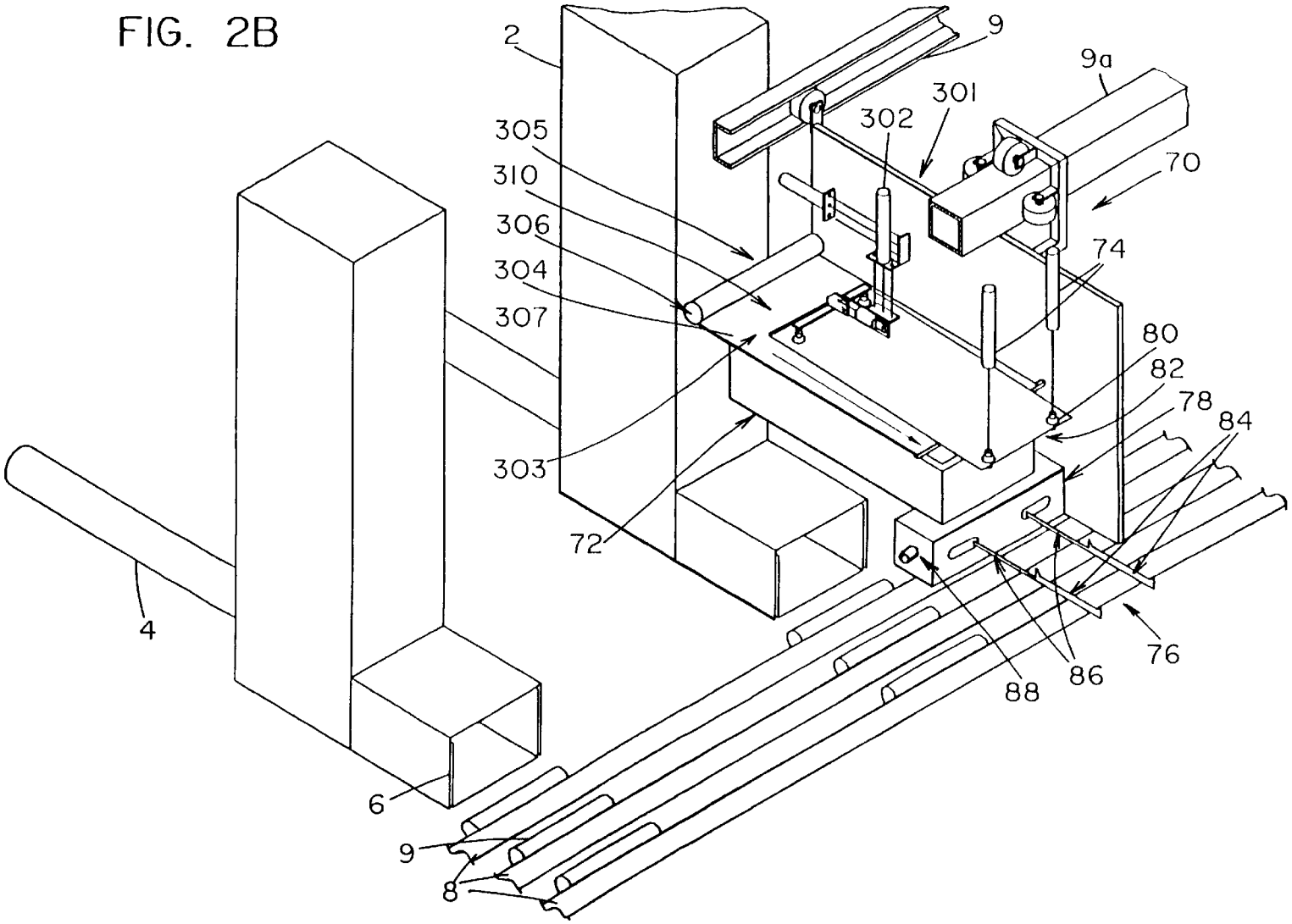
FIG. 2B is a perspective view taken along line A—A of FIG. 1 and illustrating a bag fitting apparatus according to an embodiment of the present invention in a second position.
Figure 2C:
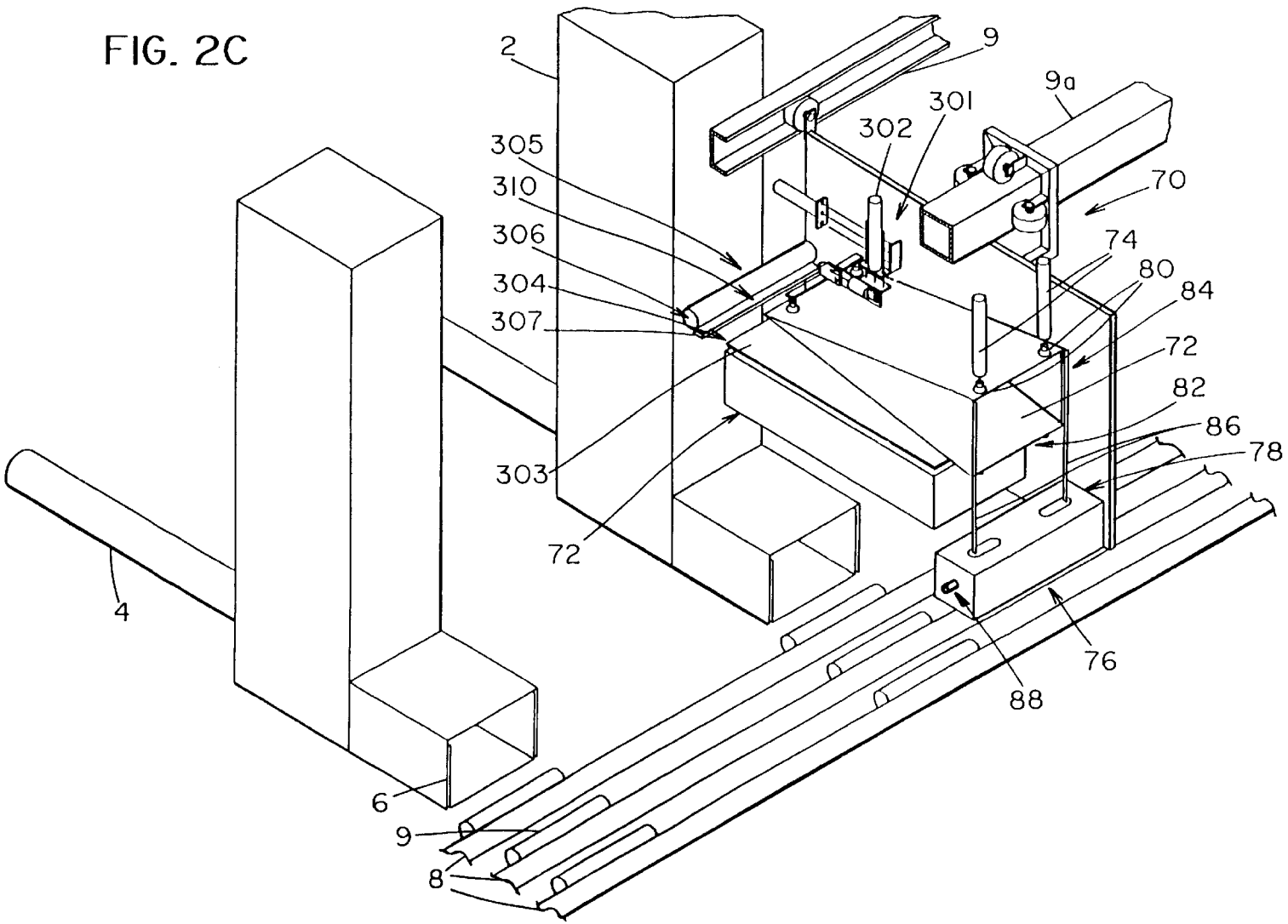
FIG. 2C is a perspective view taken along line A—A of FIG. 1 and illustrating a bag fitting apparatus according to an embodiment of the present invention in a third position.
Figure 2D:
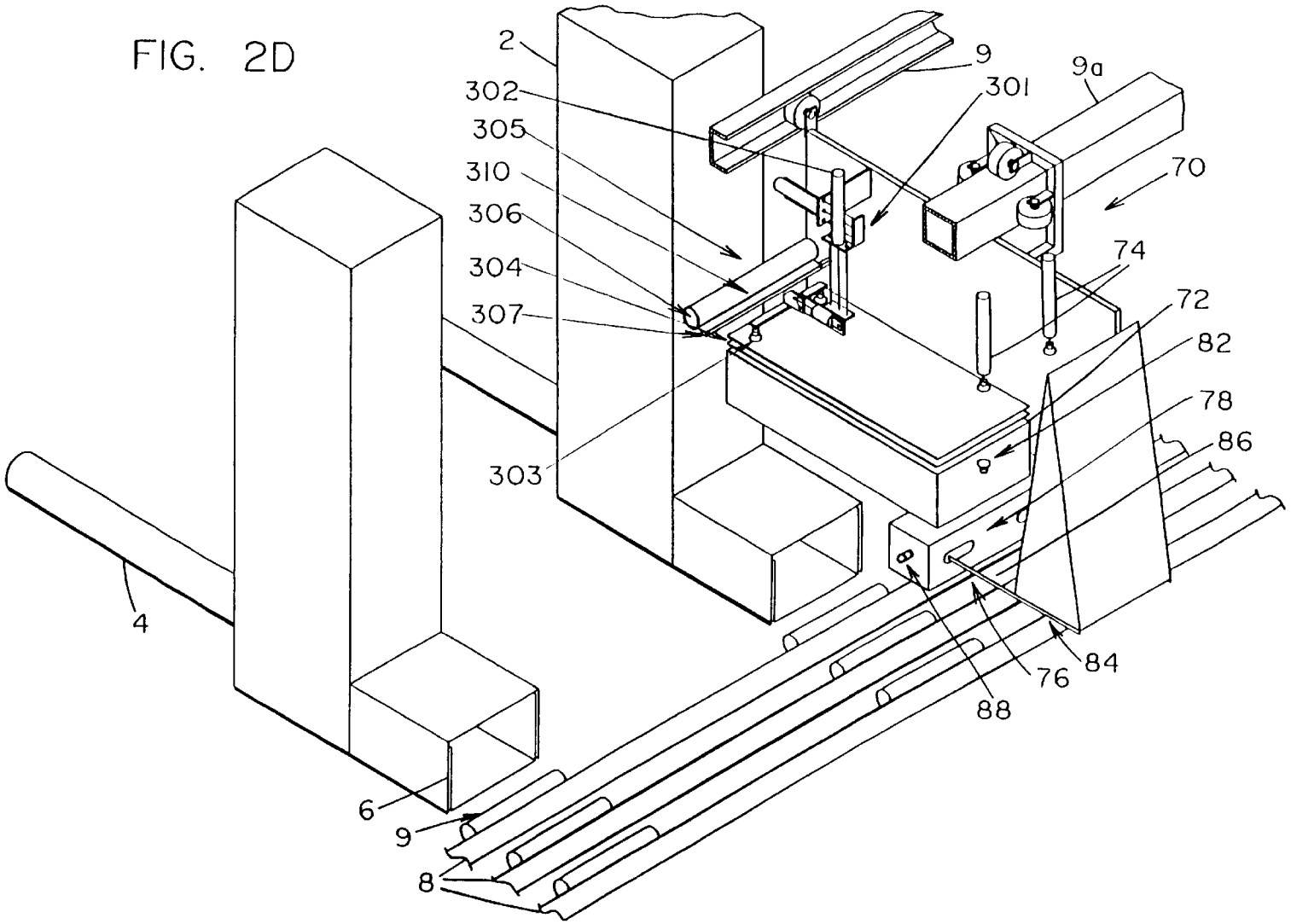
FIG. 2D is a perspective view taken along line A—A of FIG. 1 and illustrating a bag fitting apparatus according to an embodiment of the present invention in a fourth position.

A feature of the packaging apparatus 1 according to the invention is that all operations are automated. Hence problems inherent with conventional apparatus involving manual operation are eliminated. For example, since there is no longer the need to provide access to various sections, a more compact arrangement is possible. With the packaging apparatus 1 of the present invention, an arrangement with two conveyor paths close together as shown in FIG. 2B thus becomes possible.

Figure 2E:
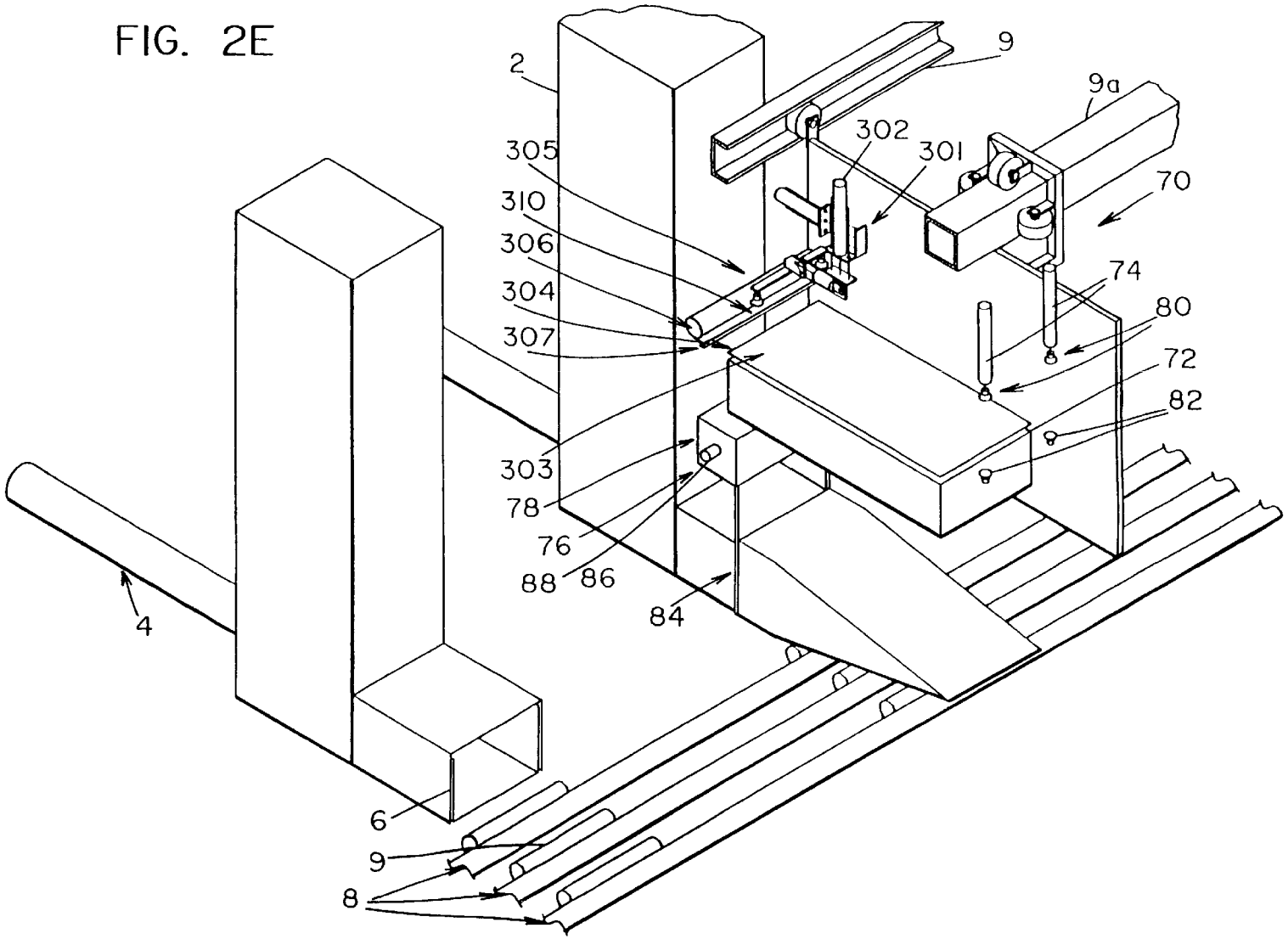
FIG. 2E is a perspective view taken along line A—A of FIG. 1 and illustrating a bag fitting apparatus according to an embodiment of the present invention in a fifth position

FIGS. 2A–2E show details of the bag fitting apparatus 7. This bag fitting apparatus is supplied with bags from the bag supply apparatus 70 as mentioned before, which comprises a bag storage magazine 72 for storing a predetermined number of preformed bags in a stack on top of each other in a flattened condition. The bag fitting apparatus 7 comprises a bag opening device 74 for opening an inlet to a bag on the top of the stack, a bag gripping device 76 for releasably gripping the bag at an inlet portion of the bag, and an actuating unit 78 for moving the gripping device 76 between an upper position where a bag opened by the bag opening device 74 can be releasably gripped by the gripping device 76 (FIG. 2C), and a position where the inlet portion of a bag being gripped by gripping device 76 is positioned over the outer peripheral surface of the outlet 6 (FIG. 2E).

As mentioned above, the bag supply apparatus 70 comprises a bag storage magazine 72 containing a number of preformed bags, stored in a stack on top of each other in a flattened condition. The magazine is generally referred to as a "cassette".

Ideally, the orientation of the bags positioned in the stack will be such that the bag inlet of each bag will face towards the bag opening device 74, with the sealed end of each bag facing away from the bag opening device 74 towards the rear of the bag fitting apparatus 7.

Ideally, the operation of the bag supply apparatus 70 should be such that when in use the stack's uppermost bag (which can be called the "active" bag for ease of reference) can be easily and efficiently separated from the balance of the stack, in particular from the bag immediately below it (which can be called the "passive" bag for ease of reference), and presented in the appropriate state for opening by the bag opening device 74.

There can be some electrostatic cling present between the bags in the stack, and this can cause fouling of the bag supply apparatus 70 if more th one bag is lifted from the stack during the process of presenting a bag to the bag opening device 74.

Figure 4:
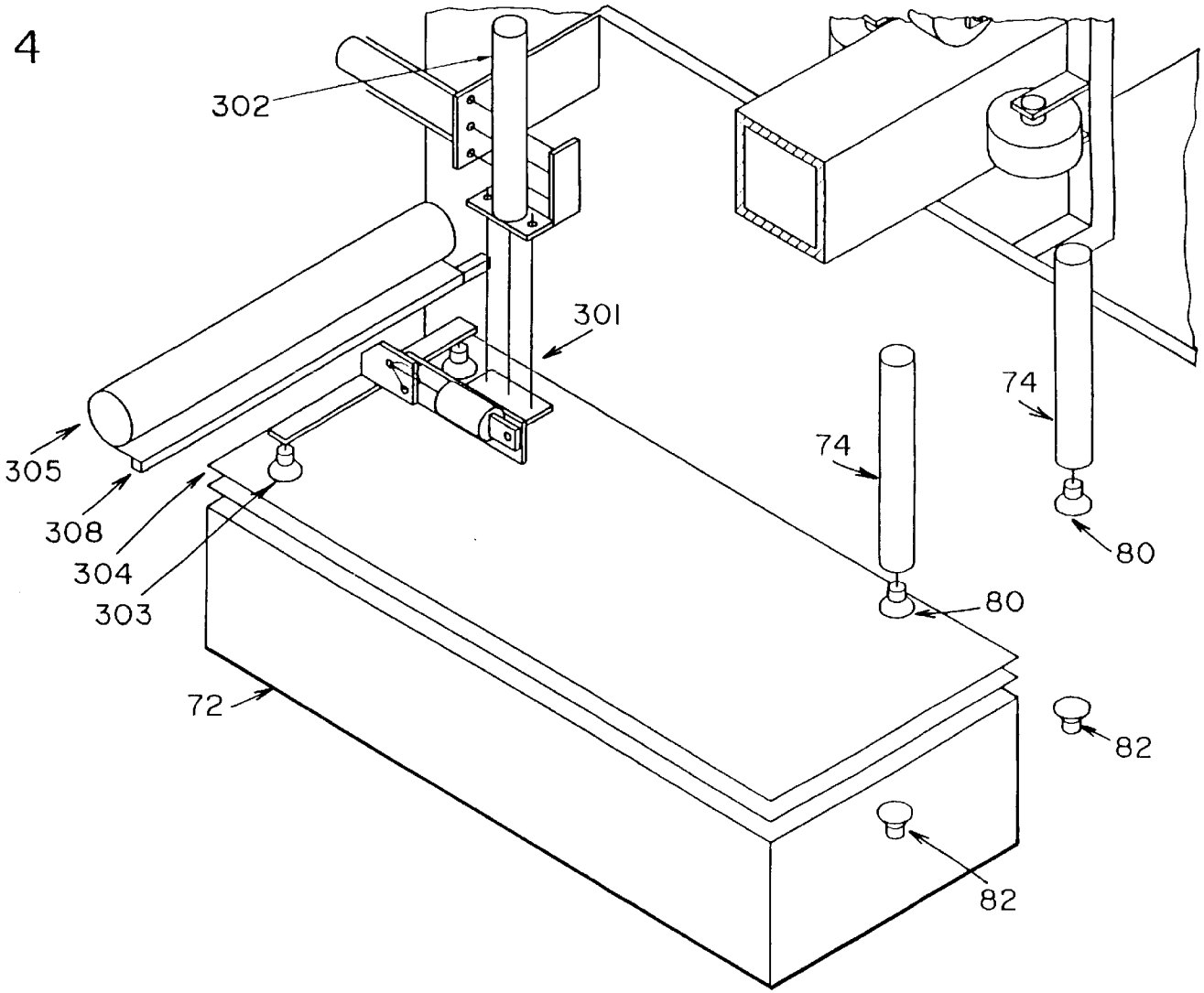
FIG. 4 is a side and end view of a bag lifting unit.

As shown by FIG. 4, a bag lifting unit 301 is provided at the rear of the bag storage magazine 72. The bag lifting unit 301 comprises a lifting member 302 provided above the stack in a first position, positioned above the sealed end of the active bag.

Lifting each bag from its sealed end is preferred as this reduces the number of creases and folds occurring in the walls of the bag, which can detract from the efficiency of the process of presenting a bag to the bag opening device 74. That is, because a bag will have a greater structural rigidity at or close to its sealed end, the walls of the bag are less likely to crease or fold in many places when the bag is lifted from its sealed end. Lifting a bag from its open end is likely to generate a number of creases or folds, which can interfere with the efficiency of the bag opening process. If the bag is lifted from its scaled end, the lifting process should generate fewer folds or creases in the walls of the bag than if the bag were lifted from its open end.

As can be seen from FIG. 4, the lifting member 302 is equipped with vacuum operated suction cups on a lower surface thereof for attaching the lifting member 302 to the outer surface of a bag, relative to the sealed end of the bag.

The lifting member 302 is capable of movement towards the stack into a second position wherein the suction cups are brought into close proximity to the stack, at which time the suction cups are brought into contact with the exposed surface of the sealed end of the active bag as aforementioned and as seen at 303. Once the suction cups are activated, the suction cups are lifted at an angle away from the surface of the active bag, in doing so taking the sealed end of the active bag with them. This action of attaching the suction cups to the sealed end of the active bag and then moving the suction cups away from the stack separates the sealed end of the active bag from the sealed end of the bag immediately beneath it in the stack, the passive bag. In moving the suction cups in his way, a gap 304 is created between the underneath surface of the sealed end of the active bag and the upper surface of the sealed end of the passive bag, which has remained on the stack in a flattened position.

The weight of the sealed end of each bag should be enough to overcome any electrostatic forces present at the sealed end of the bags such that it is not necessary to provide restraining means to hold the sealed end of the passive bag down whilst the scaled end of the active bag is lifted away from the stack. However, if need be, restraining means can be provided which ensures the passive bag, in particular the sealed end of the passive bag, and any bags immediately beneath it, are not lifted simultaneously away from the stack with the active bag.

To ensure only one bag is lifted from the stack at a time and presented for opening by the bag opening device 74, a support device is positioned relative to the lifting member 302 towards the rear of the bag storage magazine 72, and in close proximity to the top of the stack. The purpose of the support device is to provide a separating action, effectively "unpeeling" the active bag from the rest of the stack, particularly from the passive bag which is to form the top of the stack below once the active bag is removed.

Figure 5:
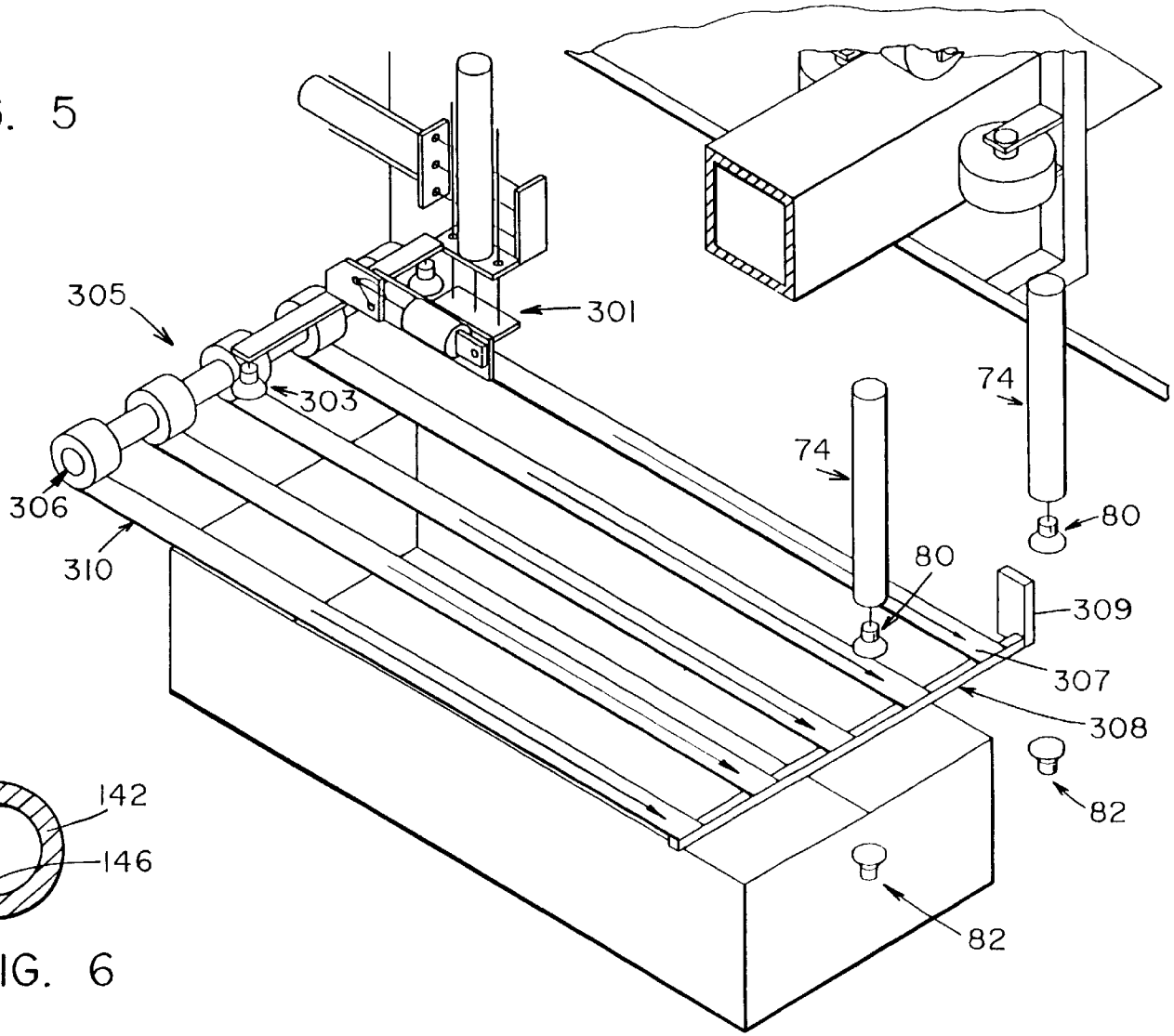
FIG. 5 is a plan, end and side view of a support device.

As shown in FIG. 5, the support device generally shown at 305 comprises a main housing 306 which contains an extendible member 307, extendible in the direction of the arrow towards the bag opening device 74. The extension (and subsequent retraction) of the extendible member 307 can be achieved either by pneumatic or hydraulic means. In the example shown in FIG. 5, the extendible member 307 can comprise a rigid front frame 308 attached to a movable arm 309. A number of extendible and retractable tapes 310 can be provided, one end of each tape being connected to the rigid front frame 308 of the support device. The other end of each tape can be held in the main housing 306 of the support device, with suitable means being provided to allow each tape to extend and retract with the extension and retraction of the extendible member 307. Alternatively the support device's extendible member 307 can comprise a solid sheet of rigid material.

Once the gap is formed as aforementioned between the sealed ends of the active and passive bags, the extendible member 307 is then extended from the support device in the direction of the bag opening device 74, and in doing so the extendible member 307 is slid under the active bag. As the extendible member is extended, the aforementioned tapes 310 are unravelled, thereby providing a support surface for the active bag to rest upon once it is separated from the stack. During the extension of the extendible member, the rigid front frame 308 acts as a "plough", peeling the active bag from the top of the stack and separating the active bag from the passive bag. Once the extendible member is fully extended towards the bag opening device 74, the active bag is now completely separated from the top of the stack. During the separation of the active bag from the rest of the stack, and in particular the passive bag, the suctions cups of the lifting member retain their grip on the sealed end of the active bag.

Once the active bag is separated from the stack, it is then positioned for engagement with the bag opening device 74.

It is desirable to ensure the positioning of the bag for presentation to the bag opening device 74 is as accurate as possible. Therefore, after the active bag has been separated from the stack it is acted upon by bag positioning means (not shown) which "shuffles" the bag from side to side such that the bag is brought into an abutting relationship with at least one strategically placed positioning guide, thereby locating the active bag in the exact position for engagement by the bag opening device 74. The "shuffling" action can be achieved by using a plate member positioned alongside the active bag which pushes the bag towards the aforementioned positioning guide(s). As the suction cups still retain a grip on the sealed end of the active bag, the lifting member can also be used to assist in the correct positioning of the active bag for engagement by the bag opening device 74.

The bag opening device 74 comprises a lifting member 80 (opening member) provided with vacuum operated suction cups on a lower surface thereof for attaching the lifting member 80 to an outer surface of the bag, a bottom wall holding device 82 provided with vacuum operated suction cups (not shown in the figure) for holding a bottom wall of the bag when positioned thereover, and a positioning mechanism (not shown in the figures) for moving the lifting member 80. The positioning mechanism moves the lifting member 80 between a first position (shown in full lines in FIG. 2B) wherein a bag can be attached to the lifting member 80 by the suction cups, and a second position (shown in FIG. 2C) wherein an upper wall of a bag attached by the suction cups is lifted to thereby open the bag inlet and lift the bag from the stack.

As shown in FIGS. 2A–2E, the bag gripping device 76 comprises two vertically aligned parallel plates 84 supported in spaced apart relation to each other by respective arms 86 which are attached to opposite ends of axially aligned shafts 88 of the actuating unit 78. The actuating unit 78 comprises a mounting unit for mounting the shafts 88 so as to be movable apart axially, so as to be rotatable about a longitudinal axis thereof and so as to be movable in a substantially horizontal plane.

In gripping the bag with the bag gripping device 76, dew actuating unit 78 moves the arms 86 relative to each other between a first separation distance at which the plates 84 can be fitted inside a bag inlet, and a second wider separation distance at which the plates 84 press against and grip the opposite vertically aligned sides of the bag inlet. With this arrangement, when the upper and lower inlet portions of the bag are being held by the suction cups of the lifting member 80 and the bottom wall holding device 82, the force due to the action of separating the arms 86 to grip the bag, can be made sufficient to separate the upper and lower inlet portions of the bag from the suction cups irrespective of whether or not suction is released from the suction cups.

When moving the gripping device 76 between the beforementioned upper left and lower right positions, the mounting shafts 88 together with the arms 86 of the gripping device 76 are turned while being moved in the horizontal plane, as shown by the successive positions FIGS. 2A–2E thereby moving a bag held by the gripping device 76 from the magazine stack to position the inlet portion of the bag over the outer peripheral surface of the outlet 6. Once positioned at the outlet 6, the mounting shafts 88 are rotated about their longitudinal axes so as to separate the plates 84, from the inside surfaces of the bag, and the arms are then moved apart away from the vicinity of the outlet 6.

The support device is not retracted back towards main housing 306 until the active bag has been removed by the bag opening device 74 from the bag supply apparatus 70. Whilst the inlet of the bag is being acted upon by the vertically aligned plates 84 of the bag gripping device 76, the suction cups of lifting member 302 retain their grip upon the sealed end of the bag during the opening process. Once the inlet of the bag has been opened as required, the suction cups of lifting member 302 are disengaged to allow the bag to be removed from the bag supply apparatus by arms 86.

In the above description, moving the arms 86 together and apart for the gripping operation, has been achieved by moving the shafts 88 axially relative to each other. However any suitable device may be used for achieving this movement. For example the arms 86 may be pivotally mounted on a single shaft so as to be pivotal relative thereto.

The block erector 10 as shown in FIG. 1 is a double plane support device comprising a first plane support surface 101 and a second plane support surface 102 aligned substantially perpendicular to each other. The support surfaces 101, 102 are in the form of conveyor tables so that a product resting thereon can be moved along the conveying path. That is in a longitudinal direction mutually parallel to the planes of the support surfaces. While not shown in FIG. 1, the block erector 10 is mounted so as to be movable between a first position (as shown in FIG. 1) where the first plane support surface 101 is substantially horizontal, and is aligned with a surface of the horizontal support device 8, and a second position wherein the second plane support surface 102 is substantially horizontal, and is aligned with a subsequent horizontal support surface of the check weigher and top up apparatus 12. This movement is provided by a vertical actuator 103. The mounting may involve a linkage device and/or guide tracks to enable accurate movement of the block erector 10 between the two positions.

In operation, a bag lying horizontally on the surface of the horizontal support device 8 after being filled by the ejection apparatus 4, can be tilted through 90 degrees by the block erector 10 to bring the bag into an upright condition with the inlet portion facing upwards. Moreover, during the tilting operation the bag will slide sideways on the first plane support surface 101 to rest against the second plane support surface 102, thus accurately aligning the bag with a predetermined path along the conveying path.

The check weigher and top up apparatus 12 comprises weighing table 121 and a discharge device in the form of a horizontally aligned auger unit 122 mounted over the weighing table 121. The auger unit 122 discharges a product contained in a hopper 124, downwards into an inlet of a bag positioned on the weighing table 121. The auger is designed so that during the topping up operation, the product discharged therefrom is spread evenly over the top of the product in the bag. Preferably this is achieved by moving the auger unit 122 relative to the bag inlet, thereby minimising any effect on the weighing operation. However depending on the measuring instrumentation it may also be possible to move the bag on the weighing table 121 relative to the auger unit 122. Control of the check weigher and top up apparatus 12 is by means of a computer, which ensures that the bag is accurately topped up with product to a predetermined weight, and the product is spread evenly, to facilitate the subsequent folding and sealing of the bag inlet.

The bag stretcher and spot sealing apparatus 14 comprises a table 141 and a folding device comprising six fingers 142 mounted relative to a base member 143 which is supported over the table 141, and a finger actuating unit 144 for inserting four of the fingers into an inlet of the bag, and positioning two of the fingers outside the bag so as to appropriately fold the side walls of the bag relative to each other to form a folded inlet gusset suitable for sealing by the vacuum sealing apparatus 20. The bag stretcher and spot sealing apparatus 14 also comprises a spot sealer 145 for providing a tack weld to the folded inlet of the bag so as to prevent unfolding. This ensures that the folded portion is reliably held in the folded condition while the bag is being conveyed to the subsequent vacuum sealing apparatus 20.

In order to accurately carry out the sealing and spot welding operation and make a neat gusset fold to ensure a good seal, the bag must be accurately positioned on the table 141. With the present embodiment, this is automatically achieved by the upstream block erector 10.

Figure 6:
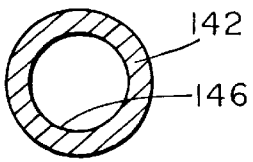
FIG. 6 is a cross-sectional view of a finger passage constructed in accordance with the teachings of the invention.

As mentioned before, instead of having a separate vacuum sealing apparatus 20, this may be combined with the bag stretcher and spot sealing apparatus 14. Such a vacuum sealing apparatus may comprise a passage 146 (FIG. 6) formed inside at least one of the fingers, a device for removing gas from the bag via the passage 146, and a sealing device for sealing the bag once gas has been removed.

The block erector 16 downstream of the bag stretcher and spot sealing apparatus 14 is the same as the block erector 10, and hence similar components are denoted by the same symbol and description is herein omitted.

Again since the bag is accurately positioned by the block erector 16, then problems such as defective sealing in the subsequent vacuum sealing apparatus 20 due to inaccurate positioning inherent with a manual positioning operation, can be eliminated.

In operation of the packaging apparatus of the embodiment, the bag fitting apparatus 7 is operated to remove a bag from the magazine stack 72 and fit an inlet region of the bag over an outer peripheral surface of the outlet 6 of the ejection apparatus 4. Once the bag is fitted, the ejection apparatus 4 is operated to eject a predetermined length of cheese (of slightly less weight than a specified final weight) from the outlet 6 into the bag, and then push the filled bag onto the conveying table 8. The filled bag of cheese is then conveyed to th block erector 10 where it is tilted to an upright condition and accurately aligned with the conveying path by means of the second plane support surface 102. The second plane support surface 102 which is a driven conveyor then transports the bag onto the check weigher and top up apparatus 12 where it is weighed while being topped up to a final specified weight by the auger unit 122. The bag is then transferred off the weighing table 121 of the check weigher and top up apparatus 12 by means of a conveying band thereon, and onto the bag stretcher and spot sealing apparatus 14. The inlet of the bag is then folded and gusseted by the fingers of the folding device, and the folded inlet then tack welded to keep the folded condition.

The bag is then transported to the second block erector 16 where it is tilted back to lie on its side, and is also accurately aligned with the conveying path, so that the folded inlet is correctly positioned ready for being guided by the rail leading to the vacuum sealing apparatus 20.

The bag is then conveyed onto the collator 18 where the bags are collated and then conveyed to the vacuum sealing apparatus 20, where they are subjected to a vacuum to remove air, and the folded inlets then heat sealed.

Figure 3:
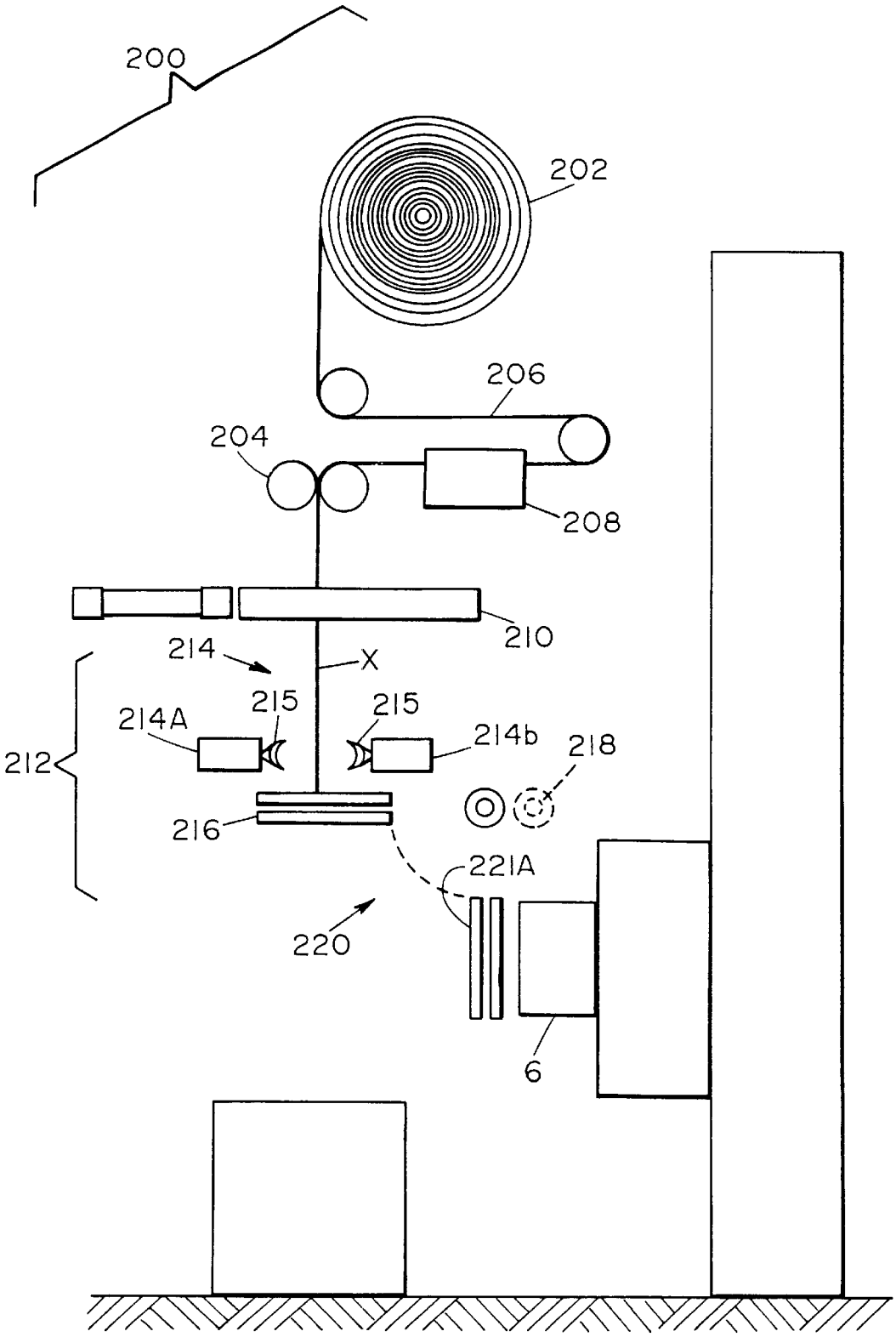
FIG. 3 is a schematic diagram of an alternative arrangement for a bag supply device.

FIG. 3 shows an alternative type of bag supply apparatus generally indicated by arrow 200. This apparatus may be preferable to the bag supply apparatus 70 in the case where bags of acceptable standard can be supplied in roll form. In FIG. 3 components the same as in the previous figures are denoted by the same symbols and description is omitted.

With this apparatus 200, bag material or preformed bags are stored in a roll 202. The bag material may be a simple flat tube of packaging material which is formed with gussets. In this case there is the requirement for a heat sealer to heat seal the gusset region, a cutter to cut off the bag, and a subsequent heat sealer to seal the bottom of the bag. Alternatively the bag material may be a roll of pre-gusseted bags with perforations between each bag. In the latter case there is no need for the gusset heat sealer, cutter and bottom heat sealer, the preformed bags being simply torn from the roll as required.

The apparatus in FIG. 3 is designed for the former type of bag material.

The bag material is fed from the roll 202 by means of feed rollers 204 and a tensioner 206 provided with a gusset sealer 208, to a cutter and head sealer 210 where the bag end is sealed and then cut into predetermined lengths by a cutter. It then falls under gravity to the bag fitting apparatus generally indicate by 212.

The bag fitting apparatus 214 for use with such a bag supply apparatus 200, comprises a bag opening device 214 for opening an inlet to a bag (indicated by X) supplied from the bag supply device 200, a bag gripping device 216 for releasably gripping an inlet portion of the bag X opened by the bag opening device 214, and an actuating unit 218 for moving the bag gripping device 216 between an upper position where an inlet portion of the bag X is gripped on both sides by arms of the gripping device 216 and a lower position where the inlet portion of the bag X being gripped by the gripping device 216 is positioned over an outer peripheral surface of an outlet 6.

The bag opening device 214 comprises two opening member 214*a,* 214*b* provided with suction cups 215 for attaching the opening members 214*a,* 214*b* to outer surfaces of the bag X, and a positioning device for moving the opening members 214*a,* 214*b* between a first position (close together position) wherein the bag X can be attached to the opening members 214*a,* 214*b* by the suction cups 215, and a second position (apart position) wherein opposite walls of the bag are moved apart to thereby open the bag inlet.

A bag gripping device 220 comprises two members 221*a,* 221*b* (only 221*a* visible in FIG. 3) supported in spaced apart relation by respective arms (not shown) so as to be movable relative to each other between a first separation distance at which they can be inserted into the bag inlet, and a greater second separation distance wherein they grip against the sides of the bag.

The two members 221*a,* 221*b* are mounted on the bag gripping device 220 so as to be rotatable about their longitudinal axis when an inlet portion of a bag being gripped thereby is positioned over the outer peripheral surface of the outlet 6. The actuating unit and its operation is similar to that of the first embodiment and will not be described further here.

In operation of the packaging apparatus of FIG. 3 fitted with the roll type bag supply apparatus 200, the feed rollers and tensioner are operated so that bag material is pulled off the roll to a predetermined length, and then gusseted and cut ready for supply to the bag fitting apparatus. In this operation the tensioner is moved to maintain tension on the roll and to allow for the stop-start feed required to enable heat scaling and cutting of the bag material.

While the present invention has been described in relation to the stack type bag supply apparatus and the roll type apparatus of FIG. 3, the invention is not limited to this. For example depending on requirements, the roll type bag supply apparatus could be modified so as to supply bags to the stack position of the first embodiment, that is to say so that bags were supplied horizontally therefrom.

In the above, the arrangement of the packaging apparatus has involved two conveyor paths each having five towers. This conforms to a conventional packaging apparatus to which the respective apparatus of the present invention are to be fitted. However, the invention is not limited to such an arrangement, and any number of towers may be provided on one or two conveying paths. Moreover, the advantages provided by the invention may result in the complete redesign of packaging apparatus so as to have a large number of towers with several bag fitting apparatus moving along the conveyor path to present the bags for filling.

Furthermore, the packaging apparatus has been described above as a packaging apparatus for packaging blocks of cheese. However, the apparatus is not to be limited to this application and can be applied to the packaging of other products especially where contamination due to human contact is a problem.

Furthermore the respective components of the packaging apparatus have been described in relation to being fitted to the packaging apparatus. However, these may also be used individually in other applications where their features may provide an advantage. For example the positioning apparatus may find application in assembly lines where an article must be accurately aligned on a conveying path.

We believe the advantages of the invention to be as follows, however it should be appreciated that the following list is given by way of example only.

1. By providing a bag fitting apparatus for the packaging apparatus, then problems inherent with manual operation such as being time consuming, risk of contamination of the product, and requiring space to allow the operator access to the region can be eliminated.
2. By providing the supplementary filling apparatus, the filling operation can be carried out effortlessly and accurately for each bag, and hence the bags can initially be slightly under filled by the ejection apparatus and topped up to an accurate weight by the filling apparatus, thus avoiding overfilling with its inherent loss of profit.
3. By providing the mechanical folding apparatus, problems with finger contamination of the surface of the inlet portion of the bag, can be eliminated. Furthermore, problems inherent with manual operation such as lack of uniformity of the surfaces resulting in wrinkles and affecting the subsequent sealing operation can be eliminated.
4. Manual workers performing the bag folding operations on a continuous basis have been affected by "Occupational Overuse Syndrome". The invention eliminates this problem.
5. By providing the positioning apparatus prior to the check weigher and top up apparatus 12 and the vacuum sealing apparatus 20, then problems due to inaccurate alignment of the bag on the conveyor path can be eliminated.

Finally it will be appreciated that the present invention has been described by way of example only and that modifications and additions may be made thereto without departing from the scope of the invention as defined in the appended claims.

What I claim is:

1. A packaging apparatus adapted for packaging a block of cheese ejected sideways from a substantially horizontally aligned outlet of a cheese formation apparatus into a bag having a longitudinal axis and a transverse axis, the outlet positioned over a substantially horizontal support device, said cheese formation apparatus having means to grip a bag when fitted over said outlet, said packaging apparatus comprising a bag fitting apparatus including:

a bag supply means;

an actuating means for moving a bag from the bag supply means to the outlet, the actuating means being constructed and the bag supply means being positioned, relative to the outlet such that the actuation means, in moving the bag from the bag supply means to the outlet, rotates the bag substantially 180 degrees about the transverse axis of the bag;

an opening means for opening the bag; and a gripping device mounted on the actuating means, the gripping device gripping an inlet region of the opened bag and being capable of fitting the inlet region of the open bag over an outer peripheral surface of said substantially horizontally aligned outlet.

2. A packaging apparatus according to claim 1, wherein the actuating means moves said bag between a first position wherein an inlet portion of the bag is gripped by the bag gripping device and a second position with the inlet portion of the bag being gripped by said gripping device is positioned over said outer peripheral surface of said substantially horizontally aligned outlet.

3. A packaging apparatus according to claim 2, wherein said bag opening means comprises an opening member provided with attachment means capable of releasably attaching said opening member to an outer surface of said bag, and positioning means for moving said opening member between a first closed position wherein said opening member can be attached to a bag by said attaching means, and a second opened position wherein a wall of a bag attached to said attachment means is moved so that said bag inlet is opened.

4. A packaging apparatus according to claim 3, wherein each said attachment means for attaching said opening member comprises a suction device for effecting a releasable attachment to an outer face of said bag.

5. A packaging apparatus according to claim 2, wherein said bag gripping means comprises at least two members supported in spaced apart relation by respective arms so as to be movable relative to each other between a first separation distance and a second separation distance, said at least two members being adapted to fit inside said bag inlet when at said first separation distance and to grip said bag when at said second separation distance.

6. A packaging apparatus according to claim 5, wherein said bags gripping means further comprises a shaft for supporting said arm and rotation means capable of turning said shaft about its longitudinal axis when an inlet portion of a bag gripped by said bag gripping means is positioned over said outer peripheral surface of said substantially horizontally aligned outlet.

7. A packaging apparatus according to claim 2, wherein said actuating means acts on a shaft provided with mounting means for mounting said shaft so that during actuation the shaft is capable of rotation about a longitudinal axis of the shaft and also sideways movement in a substantially horizontal plane, said shaft being provided with attachment means at opposite ends thereof for attachment to said bag gripping means.

8. A packaging apparatus according to claim 1, wherein the bag supply means includes bag storage means for storing bags or bag material in continuous roll form, and means for presenting bags to said bag opening means.

9. A packaging apparatus according to claim 1, wherein the bag supply means includes a bag storage means for storing a predetermined number of preformed bags in a stack in a flattened condition, and means for presenting bags to said bag opening means.

10. A packaging apparatus according to claim 3, wherein the bag supply means includes a bag storage means for storing a predetermined number of preformed bags in a stack in a flattened condition.

11. A packaging apparatus according to claim 3, wherein said attachment means comprises a suction device for effecting a releasable attachment to an outer face of said bag.

12. A packaging apparatus according to claim 1, further comprising a positioning apparatus capable of positioning a bag filled with a block of cheese by said cheese formation apparatus relative to a conveying path subsequent to said horizontal support device.

13. A packaging apparatus according to claim 12, wherein said positioning apparatus comprises a double plane support device comprising a first plane support surface and a second plane support surface aligned substantially perpendicular to each other, said support surfaces having means capable of supporting a block of cheese resting thereon and capable of moving or allowing movement of said block of cheese, and mounting means for supporting said double plane support device so as to be movable between a first position where said first plane support surface is substantially horizontal, and second position wherein said second plane support surface is substantially horizontal.

14. A packaging apparatus according to claim 1, further comprising a supplementary filling apparatus capable of filling additional cheese into a bag subsequent to being filled by said cheese block ejection apparatus.

15. A packaging apparatus according to claim 14, wherein said supplementary filling apparatus comprises discharge means mounted over a conveying path of said packaging apparatus downstream of said cheese formation apparatus, the discharge means being capable of discharging additional cheese downwards from an outlet, and means for moving said cheese discharge means relative to said conveying path.

16. A packaging apparatus according to claim 1, further comprising folding apparatus capable of folding the inlet of the bag into a form suitable for subsequent sealing.

17. A packaging apparatus according to claim 16, wherein said folding apparatus comprises fingers mounted relative to a base member, and finger actuating means capable of inserting said fingers into the inlet of said bag and appropriately folding side walls of said bag relative to each other to form a folded inlet suitable for sealing by sealing means, and fastening means for fastening the folded inlet of said bag so as to prevent unfolding.

18. A packaging apparatus according to claim 17, further comprising evacuating means for removing gas from inside said bag at the time of folding, and sealing means for sealing said bag once gas has been removed.

19. A packaging apparatus according to claim 18, wherein said evacuating means comprises a passage formed inside at least one of said fingers, and means for removing gas from said bag via said passage.

20. A packaging apparatus according to claim 16, further comprising a positioning apparatus for positioning a bag folded by said folding apparatus, relative to a conveying path leading to a sealing apparatus.

21. A packaging apparatus according to claim 20, wherein said positioning apparatus comprises a double plane support device comprising a first plane support surface and a second plane support surface aligned substantially perpendicular to each other, said support surfaces having a means for supporting a cheese block resting thereon and moving or allowing movement of said cheese block in a longitudinal direction mutually parallel to said planes, and mounting means for supporting said double plane support device so as to be movable between a first position where said first plane is substantially horizontal, and is aligned with a surface of said support of said folding apparatus, and second position wherein said second plane is substantially horizontal, and is aligned with a surface of said conveying path leading to a sealing apparatus.

22. A packaging apparatus according to claim 1, wherein the cheese is a cheese having a semi-rigid consistency.

23. A packaging apparatus according to claim 22, wherein the bag fitting apparatus is mounted on at least one track means such that a series of bags can be fitted consecutively to a plurality of substantially aligned outlets of the cheese formation apparatus to receive a block of cheese.

24. A method of packaging blocks of cheese ejected in predetermined lengths from a substantially horizontally aligned outlet of a cheese formation apparatus involving the steps of:

positioning a bag having a longitudinal axis and transverse axis in a bag supply means opening an inlet to the bag; operating gripping means so as to grip said bag in the region of said inlet;

operating actuating means so as to rotate the bag substantially 180 degrees about the transverse axis of the bag of as to position said opening over a peripheral surface of said substantially horizontally aligned outlet of said cheese formation apparatus; and releasing said gripping means and moving said gripping means away from the vicinity of said substantially horizontally aligned outlet.

25. A method of packaging blocks of cheese according to claim 24, wherein when said gripping means comprises two elongate members with side faces supported on arms, the step of operating said gripping means so as to grip said bag involves inserting said members into said inlet and moving said members apart so that said side faces respectively press against opposite inside surfaces of said bag.

26. A method of packaging blocks of cheese according to claim 25, wherein said step of releasing said gripping means involves moving said two members relative to each other so as to separate said side faces from said opposite inside surfaces of said bag, and removing said members away from the vicinity of said outlet.

* * * * *